US009509098B1

(12) United States Patent
Henry et al.

(10) Patent No.: US 9,509,098 B1
(45) Date of Patent: Nov. 29, 2016

(54) PLUGGABLE CONNECTOR HAVING BUSSED GROUND CONDUCTORS

(71) Applicant: TYCO ELECTRONICS CORPORATION, Berwyn, PA (US)

(72) Inventors: Randall Robert Henry, Harrisburg, PA (US); Michael John Phillips, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/944,677

(22) Filed: Nov. 18, 2015

(51) Int. Cl.

| | |
|---|---|
| ***H01R 12/78*** | (2011.01) |
| ***H01R 13/6471*** | (2011.01) |
| ***H01R 24/60*** | (2011.01) |
| ***H01R 13/6585*** | (2011.01) |
| *H01R 107/00* | (2006.01) |

(52) U.S. Cl.
CPC ..... *H01R 13/6471* (2013.01); *H01R 13/6585* (2013.01); *H01R 24/60* (2013.01); *H01R 2107/00* (2013.01)

(58) Field of Classification Search
CPC H01R 23/7073; H01R 23/688; H01R 12/78; H01R 12/592; H01R 23/6873; H01R 23/02; H01R 23/662; H01R 13/658
USPC ..... 439/660, 108, 496, 497
See application file for complete search history.

(56) References Cited

U.S. PATENT DOCUMENTS 4,714,435 A * 12/1987 Stipanuk ..... H05K 1/118 439/326
4,749,371 A * 6/1988 Hirai ..... H01R 12/592 439/402
4,880,388 A * 11/1989 Beamenderfer ..... H01R 23/662 439/108
5,967,831 A * 10/1999 Yamada ..... H01R 12/79 439/108
6,010,359 A * 1/2000 Etters ..... H01R 12/592 439/496
6,299,476 B1 * 10/2001 Schramme ..... H01R 12/774 439/492
6,786,771 B2 9/2004 Gailus
7,112,072 B2 9/2006 Korsunsky et al.
7,163,421 B1 1/2007 Cohen et al.
7,335,063 B2 2/2008 Cohen et al.
7,371,117 B2 5/2008 Gailus
7,581,990 B2 9/2009 Kirk et al.
7,674,134 B2 * 3/2010 Yamaji ..... H01R 9/034 439/496
7,722,401 B2 5/2010 Kirk et al.
7,753,731 B2 7/2010 Cohen et al.
7,771,233 B2 8/2010 Gailus
7,946,882 B2 * 5/2011 Wu ..... H01R 13/648 439/108
8,177,564 B1 5/2012 Ito et al.
8,523,583 B2 9/2013 Ito
8,764,464 B2 7/2014 Buck et al.
2005/0191897 A1 * 9/2005 Kondou ..... H01R 13/405 439/497
2007/0066142 A1 * 3/2007 Shindo ..... H01R 12/79 439/497
2011/0294340 A1 * 12/2011 Kojima ..... H01R 13/65807 439/497
2014/0127946 A1 5/2014 Ito et al.

* cited by examiner

*Primary Examiner* — Gary Paumen

(57) ABSTRACT

A pluggable connector includes a lead frame and a holder. The lead frame defines a first conductor array of ground conductors and signal conductors, a second conductor array of ground conductors and signal conductors, and a transition region that interconnects the first and second conductor arrays. The transition region includes a ground tie bar and distal tips of the ground conductors in the first and second conductor arrays that extend from the ground tie bar. The holder is defined by first and second holder members that have respective outer sides and inner sides. The inner sides face one another and define a seam. The first holder member holds the first conductor array of the lead frame, and the second holder member holds the second conductor array of the lead frame. The transition region of the lead frame extends across the seam at a front end of the holder.

20 Claims, 7 Drawing Sheets

PLUGGABLE CONNECTOR HAVING BUSSED GROUND CONDUCTORS

BACKGROUND OF THE INVENTION

The subject matter herein relates generally to pluggable electrical connectors that have signal and ground conductors.

Communication systems exist today that utilize electrical connectors to transmit data. For example, network systems, servers, data centers, and the like may use numerous electrical connectors to interconnect the various devices of the communication system. Many electrical connectors include signal conductors and ground conductors in which the signal conductors convey data signals and the ground conductors reduce crosstalk and/or electromagnetic interference (EMI) between the signal conductors. In differential signaling applications, the signal conductors are arranged in signal pairs for carrying the data signals. Each signal pair may be separated from an adjacent signal pair by one or more ground conductors.

There has been a general demand to increase the density of signal conductors within the electrical connectors and/or increase the speeds at which data is transmitted through the electrical connectors. As data rates increase and/or pitches between adjacent signal conductors decrease, however, it becomes more challenging to maintain a baseline level of signal integrity. For example, in some cases, electrical energy that flows through (for example, on the surface of) each ground conductor of the electrical connector may be reflected and resonate within cavities formed between ground conductors. Unwanted electrical energy, such as EMI, may be supported between nearby ground conductors. Depending on the frequency of the data transmission, electrical noise may develop that increases return loss and/or crosstalk and reduces throughput of the electrical connector.

Accordingly, there is a need for electrical connectors that reduce the electrical noise and interference caused by resonating conditions between ground conductors.

BRIEF DESCRIPTION OF THE INVENTION

In an embodiment, a pluggable connector is provided that includes a lead frame and a holder that holds the lead frame. The lead frame defines a first conductor array of ground conductors and signal conductors interspersed along a first row, a second conductor array of ground conductors and signal conductors interspersed along a second row, and a transition region that interconnects the first and second conductor arrays. The transition region includes the ground tie bar and distal tips of the ground conductors in the first and second conductor arrays that extend from the ground tie bar. The holder extends between a front end and a rear end. The holder is defined by first and second holder members that each have a respective outer side and an inner side. The inner sides of the first and second holder members face one another and define a seam therebetween. The first holder member holds the first conductor array of the lead frame at least partially along the outer side thereof. The second holder member holds the second conductor array of the lead frame at least partially along the outer side thereof. The transition region of the lead frame extends across the seam at the front end of the holder.

In another embodiment, a pluggable connector is provided that includes a lead frame, a holder, and a first ground bus plate. The lead frame defines a first conductor array of ground conductors and signal conductors interspersed along a first row, a second conductor array of ground conductors and signal conductors interspersed along a second row, and a transition region that interconnects the first and second conductor arrays. The transition region includes a ground tie bar and distal tips of the ground conductors in the first and second conductor arrays that extend from the ground tie bar. The holder extends between a front end and a rear end. The holder is defined by first and second holder members that each have a respective outer side and an inner side. The inner sides of the first and second holder members face one another and define a seam therebetween. The first holder member holds the first conductor array of the lead frame. The second holder member holds the second conductor array of the lead frame. The transition region of the lead frame extends across the seam at the front end of the holder. The first holder member defines a pocket along the outer side thereof. The pocket extends across at least some of the ground conductors and the signal conductors in the first conductor array. The ground conductors in the pocket are exposed. The signal conductors in the pocket are covered and not exposed. The first ground bus plate is received in the pocket of the first holder member. The first ground bus plate includes grounding beams extending therefrom that each align with and engage a corresponding ground conductor in the pocket at multiple points of contact.

In another embodiment, a pluggable connector is provided that includes a holder, ground conductors and signal conductors, and first and second ground bus plates. The holder extends between a front end and a rear end. The holder has a top side and a bottom side. The holder defines a first pocket along the top side and a second pocket along the bottom side. The ground conductors and the signal conductors are arranged in a first conductor array along the top side and in a second conductor array along the bottom side. At least some of the ground conductors span from the top side to the bottom side. At least some of the ground conductors and the signal conductors define a mating segment proximate to the front end of the holder and a jogged segment that is offset relative to the mating segment and located between the mating segment and the rear end. The jogged segments of the ground conductors and the signal conductors in the first and second conductor arrays extend through the first and second pockets of the holder, respectively. The ground conductors are exposed in the respective first and second pockets. The first and second ground bus plates are received in the first and second pockets, respectively, of the holder. The first and second ground bus plates each include grounding beams extending therefrom. The grounding beams of the first ground bus plate align with and engage corresponding ground conductors in the first pocket at multiple points of contact. The grounding beams of the second ground bus plate align with and engage corresponding ground conductors in the second pocket at multiple points of contact.

DETAILED DESCRIPTION OF THE INVENTION

Figure 1:
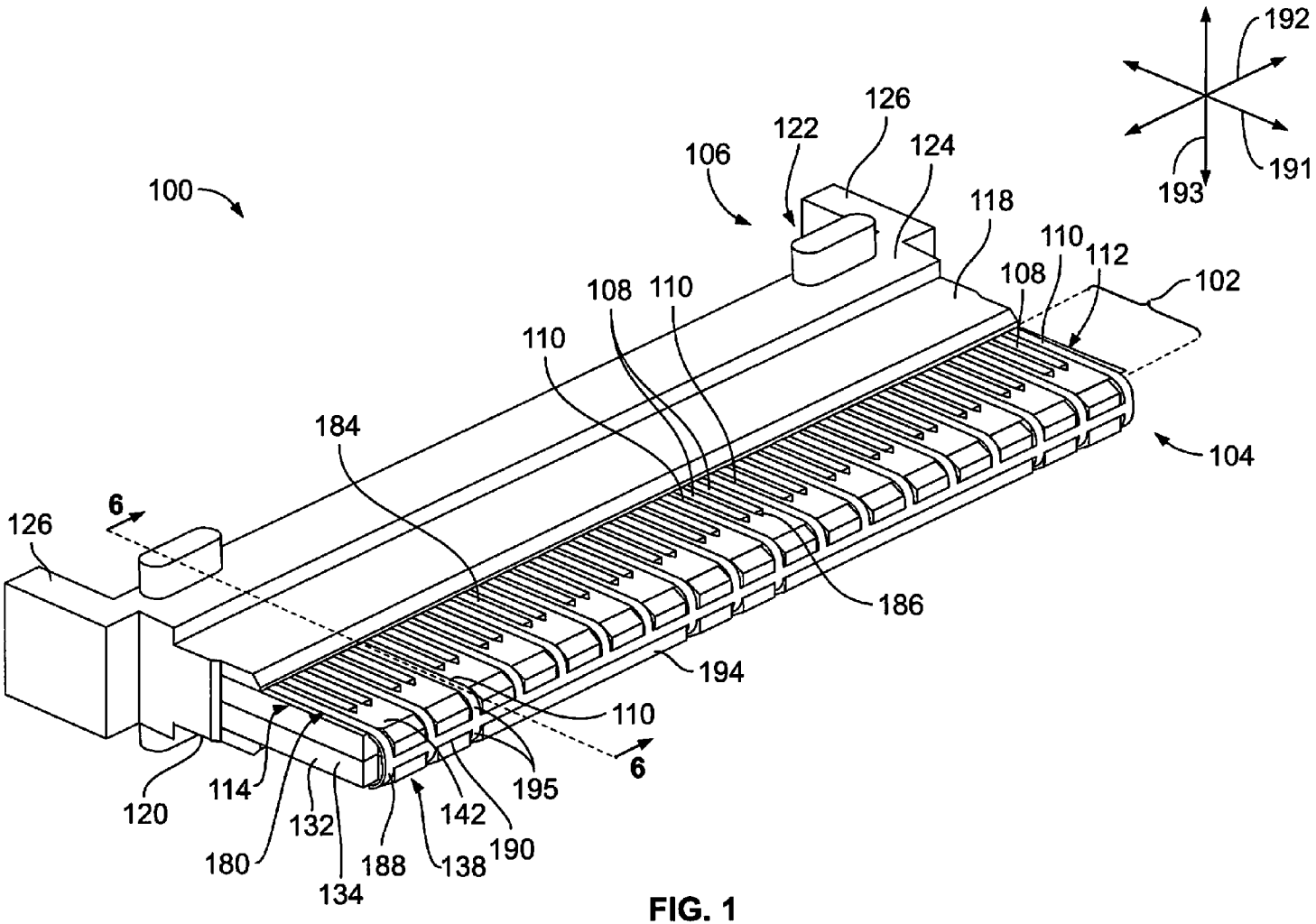
FIG. 1 is a top front perspective view of pluggable connector according to an embodiment.

Embodiments set forth herein may include various electrical connectors of a connector system that are configured for communicating data signals. A first electrical connector of the connector system mates with a corresponding second electrical connector to communicatively interconnect different components of a communication system. In various embodiments, the electrical connectors are particularly suitable for high-speed communication systems, such as network systems, servers, data centers, and the like, in which the data rates may be greater than 5 gigabits/second (Gbps), but the electrical connectors may also be suitable for data rates less than 5 Gbps. The embodiments set forth herein are designed to address various high speed grounding issues recognized in known connector systems.

One or more embodiments described herein are directed to a pluggable connector that utilizes a single lead frame to stamp both an upper row of contacts and a lower row of contacts simultaneously. Designated grounding pins remain attached between the upper and lower rows across the lateral width of the connector, which buses the ground contacts of the upper row to the ground contacts of the lower row. The ground pins extend along a face or mating end of the pluggable connector to provide a grounding location generally at a mid-point of a ground length defined through the pluggable connector and a mating receptacle connector. The lead frame is then insert molded in two halves such that the upper row of contacts are held in a first overmold body and the lower row of contacts are held in a second overmold body. The contacts of the lead frame may have jogged segments within the overmold bodies to support retention of the contacts within the overmold bodies, as the molded material may encase the jogged segments. The two halves are then folded together such that the first and second overmold bodies are stacked on one another.

At least one of the first and second overmold bodies defines a relief area that is recessed and configured to receive a continuous ground bus therein. The pluggable connector may be terminated to a printed circuit board at a rear of the connector. The ground bus may be located at an approximate mid-point longitudinally between the face or mating end of the pluggable connector and the rear or terminating end of the pluggable connector (where the grounds of the contacts are bussed on the printed circuit board). The ground bus has contact beams that are configured to engage the ground contacts. For example, the contact beams may be configured to deflect towards the ground contacts as the contact assembly (comprised of the lead frame, overmold bodies, and the at least one ground bus) is inserted into a housing collar during assembly of the pluggable connector. The jogged segments of the contacts may also provide sufficient clearance for the ground bus and the deflectable contact beams thereof without increasing the height of the contact assembly and the ability of the contact assembly to be received within the housing collar.

As a result, the pluggable connector electrically commons the ground contacts at the mating end of the pluggable connector as well as generally midway between the mating end and the terminating end. The reduced lengths between grounding locations may improve signal integrity through the pluggable connector by reducing an amount of interference that reflects and/or resonates along the ground contacts.

Figure 2:
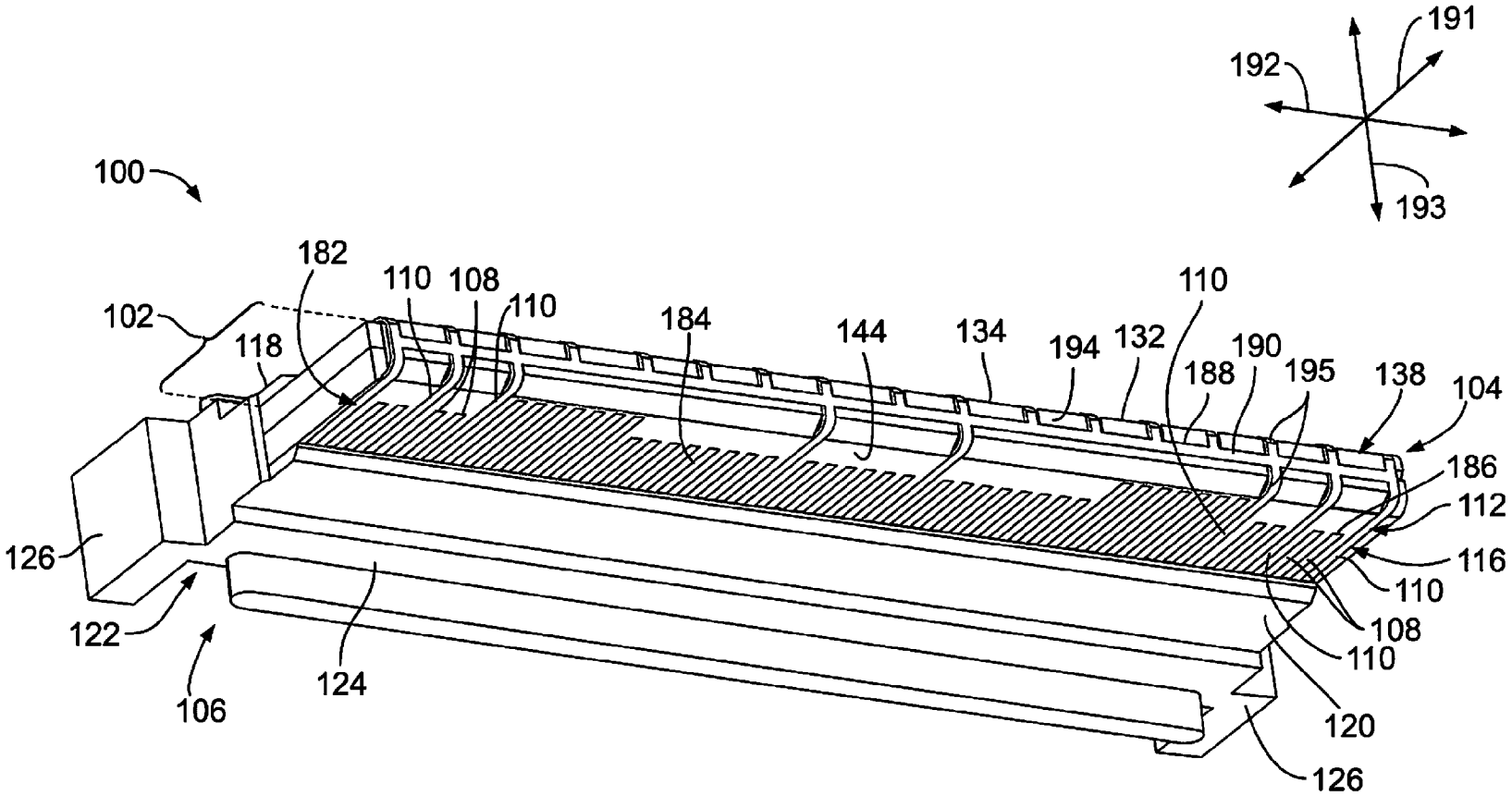
FIG. 2 is a bottom front perspective view of the pluggable connector shown in FIG. 1.

FIG. 1 is a top front perspective view of pluggable connector 100 according to an embodiment. FIG. 2 is a bottom front perspective view of the pluggable connector 100 shown in FIG. 1. The pluggable connector 100 is configured to mate with a mating connector (not shown) to establish an electrical connection between the pluggable connector 100 and the mating connector. Specifically, the pluggable connector 100 includes a tray 102 at a mating end 104 thereof that is configured to be received in a receptacle (not shown) of the mating connector, such that the mating connector is referred to herein as a receptacle connector. The receptacle connector may have any structure, such as, but not limited to, a board-mount connector that is mounted to a host circuit board, a cable-mount connector that terminates to one or more wire cables, a pass-through connector that is mounted through an opening in a panel, and/or the like.

The pluggable connector 100 may be used in various applications. One non-limiting example application is in a transceiver assembly (not shown) for use in a server, a switch, a personal computer, or the like. For example, the pluggable connector 100 may be a component of an input/output (I/O) module connector that is configured to mate with a receptacle connector that is mounted to a host board and optionally held within a receptacle cage. The pluggable connector 100 and the receptacle connector may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable connector 100 may be configured to be compliant with a small form factor (SFF) specification, such as SFF-8644 and SFF-8449 HD. The pluggable connector 100 may be a high-speed electrical connector that is capable of transmitting data at a rate of at least about five (5) gigabits per second (Gbps), at least about 10 Gbps, at least about 20 Gbps, at least about 40 Gbps, or more.

A terminating end 106 of the pluggable connector 100 is configured to be electrically connected to a circuit board (not shown), one or more wire cables (not shown), or the like. In the illustrated embodiment, the pluggable connector 100 defines a cavity 122 at the terminating end 106 for receiving a circuit board to terminate the pluggable connector 100 to the circuit board. The cavity 122 is at least partially defined by a housing 124 of the pluggable connector 100. The housing 124 includes ears 126 that are configured to engage edges of the circuit board.

The pluggable connector 100 includes signal conductors 108 and ground conductors 110 that may be electrically connected to the circuit board at the terminating end 106 via soldering or other surface mounting, thru-hole mounting, or the like. The ground conductors 110 provide shielding for the signal conductors 108. Portions of the signal conductors 108 and ground conductors 110 extend along the tray 102 for electrically connecting to corresponding mating conductors (not shown) of the receptacle connector. The signal conductors 108 and ground conductors 110 are arranged in a first conductor array 114 that is shown in FIG. 1 and a second conductor array 116 that is shown in FIG. 2. The first conductor array 114 is disposed generally along or proximate to a first side 118 of the pluggable connector 100, and the second conductor array 116 is disposed generally along or proximate to an opposite second side 120 of the pluggable connector 100.

The pluggable connector 100 is oriented with respect to mutually perpendicular axes, including a mating axis 191, a lateral axis 192, and a vertical or elevation axis 193. Although the vertical axis 193 extends parallel to a gravitational force direction, it should be understood that embodiments described herein are not limited to having a particular orientation with respect to gravity. The pluggable connector 100 includes the housing 124 and a contact assembly 132. The contact assembly 132 extends beyond the housing 124 along the mating axis 191 to the mating end 104 of the pluggable connector 100. For example, the tray 102 is part of the contact assembly 132. The contact assembly 132 includes at least a holder 134 and a conductive lead frame 112 held by the holder 134. A front end 138 of the holder 134 defines at least a portion of the mating end 104 of the pluggable connector 100. The signal conductors 108 and the ground conductors 110 of both the first and second conductor arrays 114, 116 are components of the lead frame 112.

Referring to FIG. 1 only, the signal conductors 108 and ground conductors 110 in the first conductor array 114 of the lead frame 112 are interspersed along a first row 180. The first row 180 extends parallel to the lateral axis 192. The signal conductors 108 and ground conductors 110 each extend parallel to the mating axis 191. The signal conductors 108 in the first conductor array 114 are arranged in a plurality of signal pairs. Adjacent pairs of signal conductors 108 are separated by a ground conductor 110. Thus, the signal conductors 108 and ground conductors 110 are arranged in a repeating ground-signal-signal-ground (GSSG) sequence in which each pair of signal conductors 108 is located between two ground conductors 110. The pairs of signal conductors 108 may be configured to convey high speed differential signals, and the ground conductors 110 provide shielding between adjacent pairs. In an alternative embodiment, more than one ground conductor 110 may be located between adjacent pairs of signal conductors 108. Although the entire first conductor array 114 includes the repeating GSSG sequence of signal conductors 108 and ground conductors 110 in the illustrated embodiment, in other embodiments the signal conductors 108 and the ground conductors 110 may have other arrangements for at least one or more portions of the first row 180.

Referring now to FIG. 2 only, the signal conductors 108 and ground conductors 110 in the second conductor array 116 of the lead frame 112 are interspersed along a second row 182 that extends parallel to the lateral axis 192. Like the first conductor array 114 shown in FIG. 1, the signal conductors 108 and ground conductors 110 in the second conductor array 116 each extend parallel to the mating axis 191. Unlike the first conductor array 114, the second conductor array 116 does not have a repeating sequence of signal conductors 108 and ground conductors 110 along the entire lateral width of the row 182. For example, the second conductor array 116 includes two GSSG sub-arrays at each end of the row 182, where each GSSG sub-array includes a pair of signal conductors 108 surrounded on each side by a ground conductor 110. The signal conductors 108 of the second conductor array 116 along a middle region of the row 182 between the GSSG sub-arrays may be used for other than high speed differential signals, such as for power, sense signals, or other low speed signals. The numbers, types, and arrangements of the signal conductors 108 and ground conductors 110 in the second conductor array 116 may be different in other embodiments.

Referring now to both FIGS. 1 and 2, the signal conductors 108 and ground conductors 110 in the first and second conductor arrays 114, 116 have mating segments 184 proximate to the front end 138 of the holder 134 that are configured to slidably engage corresponding conductors of the mating receptacle connector. The mating segments 184 of the first conductor array 114 are disposed along a top side 142 of the holder 134, and the mating segments 184 of the second conductor array 116 are disposed along an opposite bottom side 144 of the holder 134. As used herein, relative or spatial terms such as "front," "rear," "top," "bottom," "first," and "second" are only used to distinguish the referenced elements of the pluggable connector 100 and do not necessarily require particular positions or orientations relative to gravity and/or the surrounding environment of the pluggable connector 100.

The mating segments 184 are exposed on the respective top and bottom sides 142, 144 for engaging the conductors of the mating receptacle connector. As used herein, an "exposed" component means that the component is not fully encased, surrounded, or covered by another component, such as a molded body. Thus, an "exposed" component may be partially surrounded or embedded in another component, but not fully encased in the other component. Distal ends 186 of the mating segments 184 of the signal conductors 108 are spaced apart from the front end 138 of the holder 134, while the ground conductors 110 extend fully to the front end 138 to ensure that the ground conductors 110 engage and electrically connect to corresponding mating conductors of the receptacle connector prior to the signal conductors 108 engaging the corresponding mating conductors.

The lead frame 112 is electrically conductive and formed of a conductive metal material such as copper or a copper alloy, silver, or the like. In addition to the first and second conductor arrays 114, 116, the lead frame 112 further includes a transition region 188 that interconnects the first and second conductor arrays 114, 116. More specifically, the transition region 188 interconnects the ground conductors 110 of the first conductor array 114 and the ground conductors 110 of the second conductor array 116. At least some of the ground conductors 110 span from the top side 142 to the bottom side 144 through the transition region 118. The transition region 188 is disposed at the front end 138 of the holder 134.

The transition region 188 includes a ground tie bar 190 and distal tips 195 of the ground conductors 110. The ground tie bar 190 extends transverse to the mating axis 191, in contrast to the signal conductors 108 and ground conductors 110 that extend parallel to the mating axis 191. In an embodiment the ground tie bar 190 extends parallel to the lateral axis 192 (and perpendicular to the mating axis 191). The distal tips 195 of the ground conductors 110 extend from the ground tie bar 190. For example, the distal tips 195 extend from the ground tie bar 190 to the mating segments 184 of the ground conductors 110 disposed on the respective top and bottom sides 142, 144 of the holder 134. In an embodiment, the distal tips 195 of the ground conductors 110 are formed integral to the ground tie bar 190. Therefore, the ground conductors 110 in both the first and second conductor arrays 114, 116 extend from the ground tie bar 190.

The ground tie bar 190 is configured to electrically common the ground conductors 110 of the lead frame 112, including the ground conductors 110 in both the first and second conductor arrays 114, 116. Thus, a respective ground conductor 110 in the first conductor array 114 is interconnected and electrically connected to the other ground conductors 110 in the first conductor array 114 as well as the ground conductors 110 in the second conductor array 116 via the transition region 188 of the lead frame 112.

The front end 138 of the holder 134 includes a front wall 194 that extends vertically between the top side 142 and the bottom side 144. The transition region 188 of the lead frame 112 extends along the front wall 194. For example, the ground tie bar 190 extends laterally along the front wall 194. The distal tips 195 of the ground conductors 110 in the first conductor array 114 extend generally upwards from the ground tie bar 190 towards and along the top side 142 of the holder 134, and the distal tips 195 of the ground conductors 110 in the second conductor array 116 extend generally downwards from the ground tie bar 190 towards and along the bottom side 144 of the holder 134.

Figure 3:
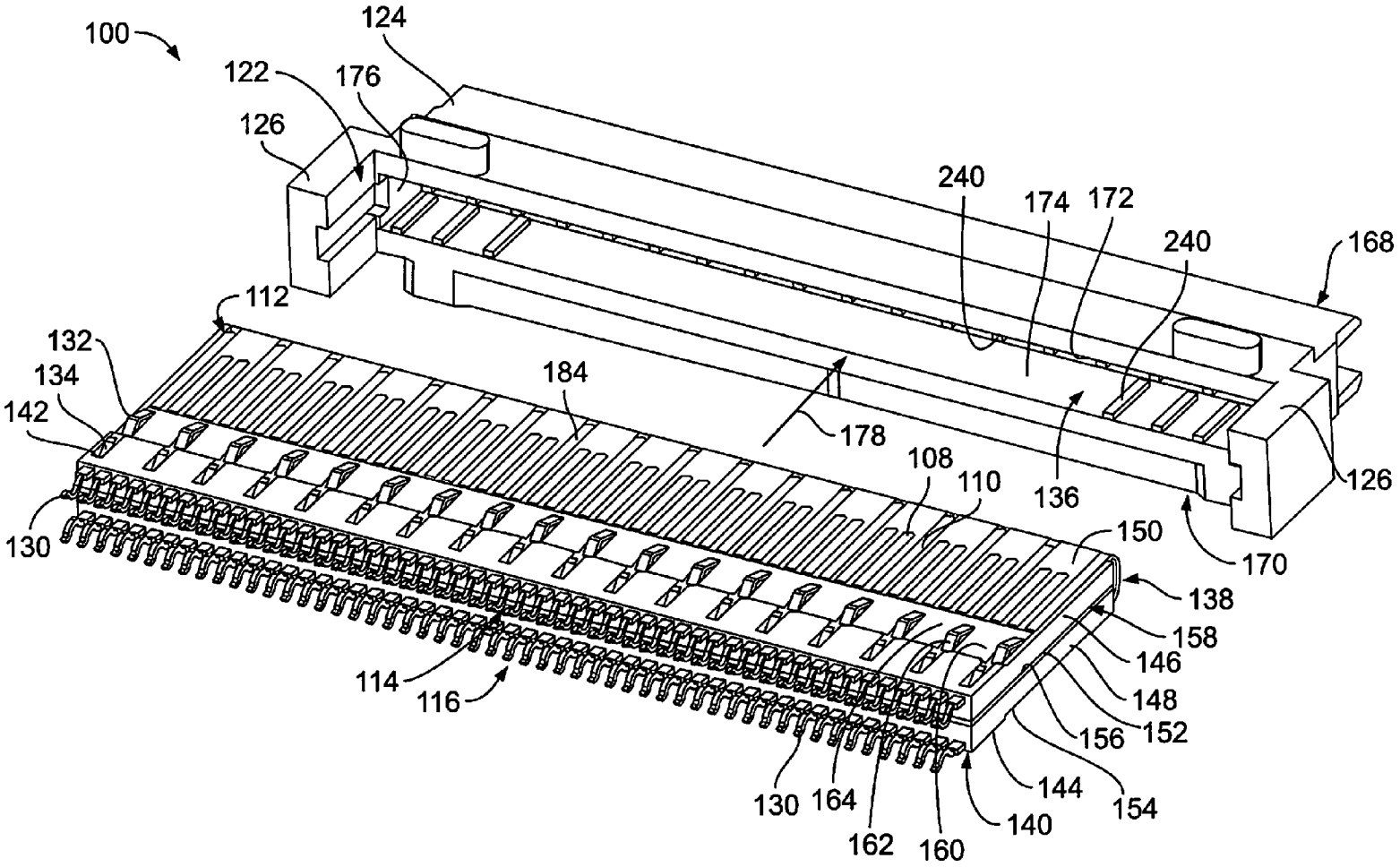
FIG. 3 is a partially exploded view of the pluggable connector according to an embodiment.
Figure 4:
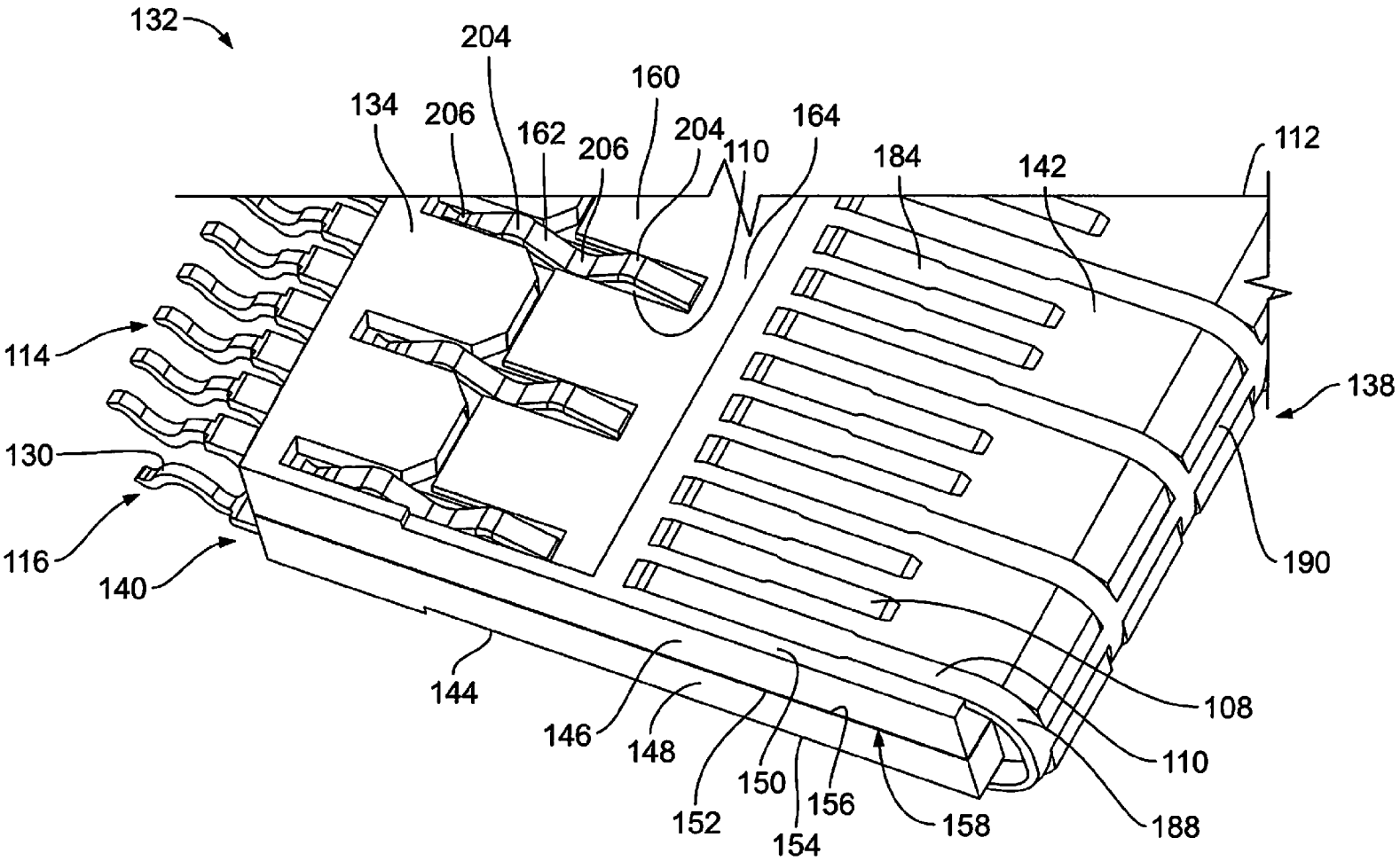
FIG. 4 is an enlarged view of a portion of a contact assembly of the pluggable connector shown in FIG. 3.

FIG. 3 is a partially exploded view of the pluggable connector 100 according to an embodiment. The contact assembly 132 is shown poised for loading into a slot 136 of the housing 124 to assemble the pluggable connector 100. FIG. 4 is an enlarged view of a portion of the contact assembly 132 shown in FIG. 3. The following description applies to both FIGS. 3 and 4 unless otherwise noted.

The holder 134 of the contact assembly 132 extends from the front end 138 to a rear end 140. Terminating ends 130 of the signal conductors 108 and ground conductors 110 extend from the rear end 140 of the holder 134. The signal conductors 108 and ground conductors 110 of the lead frame 112 are spaced apart from one another laterally along the holder 134 to electrically separate the conductors 108, 110 from one another and prevent electrical shorts. The holder 134 is composed at least partially of a dielectric material, such as one or more plastics or other polymers.

In an exemplary embodiment, the holder 134 is defined by a first holder member 146 and a second holder member 148. The first and second holder members 146, 148 are stacked together. The first holder member 146 includes an outer side 150 and an opposite inner side 152. The second holder member 148 also includes an outer side 154 and an opposite inner side 156. The first and second holder members 146, 148 are arranged such that the inner side 152 of the first holder member 146 faces the inner side 156 of the second holder member 148. The holder members 146, 148 define a seam 158 between the inner sides 152, 156. In an embodiment, the inner side 152 of the first holder member 146 abuts the inner side 156 of the second holder member 148 in direct engagement at the seam 158. Alternatively, the inner sides 152, 156 may be at least slightly spaced apart from one another at the seam 158 via one or more coupling pins, spacers, conductive layers, or the like. The outer sides 150, 154 of the first and second holder members 146, 148, respectively, face outwards away from the seam 158. As shown in FIG. 4, the transition region 188 of the lead frame 112 extends across the seam 158 at the front end 138 of the holder 134. The ground tie bar 190 may align with the seam 158 and extend laterally along the seam 158.

The outer side 150 of the first holder member 146 defines the top side 142 of the holder 134, and the outer side 154 of the second holder member 148 defines the bottom side 144 of the holder 134. In an embodiment, the first holder member 146 holds the first conductor array 114 of the lead frame 112, and the second holder member 148 holds the second conductor array 116 of the lead frame 112. The first conductor array 114 is at least partially exposed along the outer side 150 of the first holder member 146 for engaging the mating conductors of the mating receptacle connector. With additional reference to FIG. 2, the second conductor array 116 is at least partially exposed along the outer side 154 of the second holder member 148 for engaging the mating conductors of the mating receptacle connector. For example, the mating segments 184 of the signal and ground conductors 108, 110 in the first and second conductor arrays 114, 116 are exposed along the corresponding outer sides 150, 154.

The contact assembly 132 further includes at least one ground bus plate held by the holder 134 along the top side 142 and/or the bottom side 144. For example, the contact assembly 132 includes a first ground bus plate 160 coupled to the top side 142 of the holder 134 (for example, to the outer side 150 of the first holder member 146). The first ground bus plate 160 extends across at least some of the signal conductors 108 and ground conductors 110 in the first conductor array 114. The first ground bus plate 160 is configured to engage at least some of the ground conductors 110 of the first conductor array 114 to electrically common the ground conductors 110 (that the first ground bus plate 160 engages). The first ground bus plate 160 is disposed between the front end 138 and the rear end 140 of the holder 134. In an embodiment, the first ground bus plate 160 may be located approximately midway along the length of the ground conductors 110. Thus, the first ground bus plate 160 may effectively divide a ground path length of the ground conductors 110 approximately in half. The shorter ground path length may improve signal integrity through the pluggable connector 100 by reducing an amount of interference that reflects and/or resonates along the ground conductors 110. The first ground bus plate 160 is composed of a conductive material, such as one or more metals. Optionally, the first ground bus plate 160 may be stamped and formed from a panel or sheet of metal.

In an embodiment, the first ground bus plate 160 engages the corresponding ground conductors 110 via grounding beams 162 that extend from the ground bus plate 160. Each grounding beam 162 aligns with and engages one corresponding ground conductor 110 of the first conductor array 114. The grounding beams 162 may be formed integral to a base plate 164 of the first ground bus plate 160, such as through a stamping and forming process. The grounding beams 162 are deflectable. In an embodiment, the grounding beams 162 each engage the corresponding ground conductor 110 at multiple points of contact. The multiple points of contact may further reduce the ground path lengths along the ground conductors 110, thereby further improving signal integrity.

As shown in FIG. 4, the grounding beams 162 may have an undulating contour including peaks 204 and valleys 206. The peaks 204 of the grounding beams 162 of the first ground bus plate 160 may extend vertically outward beyond the top side 142 of the holder 134, at least when the contact assembly 132 is not loaded in the slot 136 of the housing 124. The valleys 206 extend towards and engage the ground conductors 110. In the illustrated embodiment, the grounding beams 162 each have two valleys 206 and therefore engage the corresponding ground conductors 110 at two points of contact. But, in other embodiments, the grounding beams 162 may engage the ground conductors 110 at only one or more than two points of contact.

Figure 6:
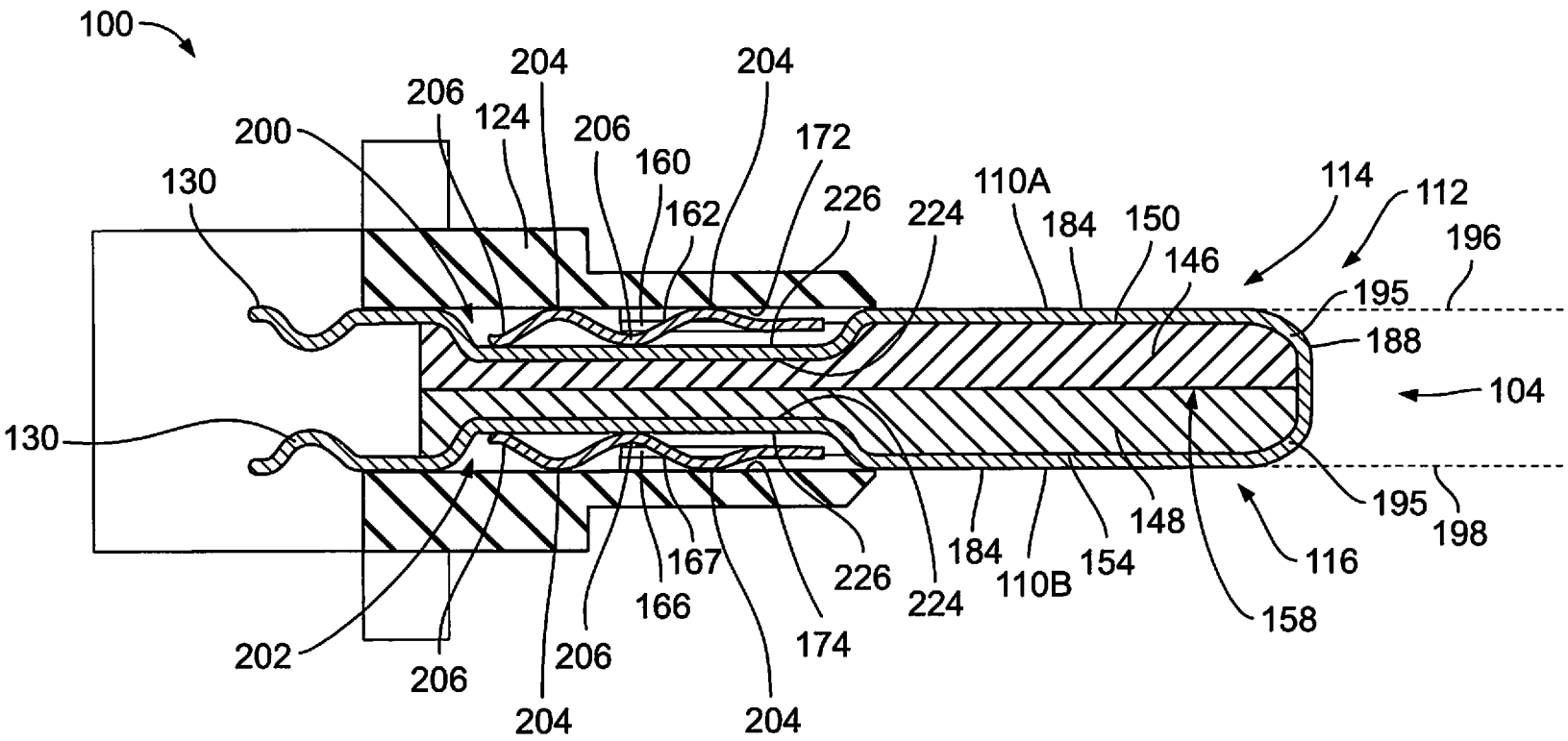
FIG. 6 is a cross-sectional view of the pluggable connector taken along the line 6-6 shown in FIG. 3.

Although not shown in FIGS. 3 and 4, the contact assembly 132 may also include at least one second ground bus plate 166 (shown in FIG. 6) that is held by the holder 134 along the bottom side 144 (for example, by the outer side 154 of the second holder member 148). The second ground bus plate 166 may be similar to the first ground bus plate 160. For example, the second ground bus plate 166 extends across at least some of the ground conductors 110 in the second conductor array 116 and engages the corresponding ground conductors 110 via grounding beams 167 (shown in FIG. 6) to electrically common the ground conductors 110. The grounding beams 167 may be similar to the grounding beams 162, including peaks 204 (shown in FIG. 6) and valleys 206 (FIG. 6). The peaks 204 of the grounding beams 167 may extend vertically outward beyond the bottom side 144 of the holder 134.

Referring now to only FIG. 3, the housing 124 of the pluggable connector 100 extends between a front end 168 and a rear end 170. The ears 126 of the housing 124 extend rearward from the rear end 170 to define at least part of the cavity 122 for receiving the circuit board. The slot 136 of the housing 124 extends through the housing 124 between the front and rear ends 168, 170, such that the slot 136 is open at both ends 168, 170. The slot 136 is defined by interior walls, such as an upper interior wall 172, a lower interior wall 174, and two side interior walls 176 that extend between the upper and lower interior walls 172, 174. Only one side interior wall 176 is visible in FIG. 3. In an embodiment, the housing 124 is formed at least partially of a dielectric material, such as one or more plastics or other polymers.

The contact assembly 132 is inserted in the slot 136 of the housing 124 to form the pluggable connector 100. The contact assembly 132 is configured to be loaded into the slot 136 in a loading direction 178 from the rear end 170 towards the front end 168. When the contact assembly 132 is fully loaded in the housing 124, the contact assembly 132 extends through the slot 136 such that the front end 138 of the holder 134 protrudes from the front end 168 of the housing 124. The slot 136 is sized such that the interior walls 172-176 secure the first holder member 146 of the holder 134 in position relative to the second holder member 148. In an embodiment, the upper interior wall 172 (or protrusions thereon) engages the grounding beams 162 of the first ground bus plate 160 to press the grounding beams 162 into engagement with the corresponding ground conductors 110 in the first conductor array 114. The upper interior wall 172 also blocks the ground beams 162 from deflecting away from and out of direct contact with the ground conductors 110. For example, the upper interior wall 172 may include ribs 240 that protrude from the upper interior wall 172 into the slot 136. The ribs 240 are configured to align with and engage the grounding beams 162 of the contact assembly 132. The lower interior wall 174 also includes ribs 240 that are configured to engage the grounding beams 167 (shown in FIG. 6) of the second ground bus plate 166 (FIG. 6) to press the grounding beams 167 into engagement with the corresponding ground conductors 110 in the second conductor array 116.

Figure 5:
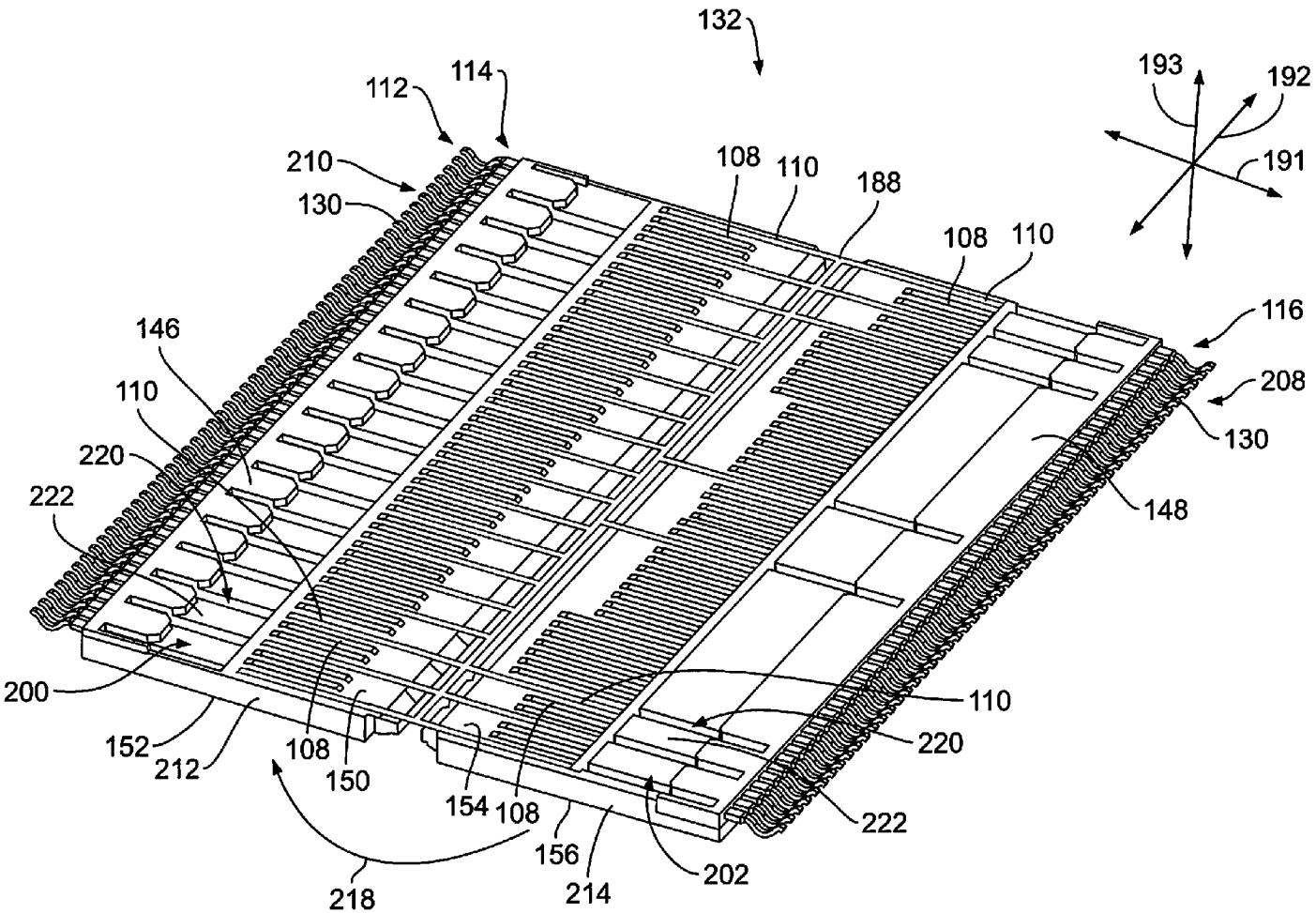
FIG. 5 is a perspective view of the contact assembly in a pre-assembled state.

FIG. 5 is a perspective view of the contact assembly 132 in a pre-assembled state. The first and second ground bus plates 160, 166 (both shown in FIG. 6) of the contact assembly 132 are not shown in FIG. 5. In an embodiment, the contact assembly 132 includes a single lead frame 112 that may be stamped and formed from sheet metal. The lead frame 112 extends along the mating axis 191 between a first end 208 and a second end 210. The first end 208 is defined by the terminating ends 130 of the signal and ground conductors 108, 110 in the second conductor array 116, and the second end 210 is defined by the terminating ends 130 of the signal and ground conductors 108, 110 in the first conductor array 114. The transition region 188 is disposed midway between the first and second ends 208, 210 of the lead frame 112. As show in FIG. 5, the transition region 188 interconnects the ground conductors 110 in the first conductor array 114 to the ground conductors 110 in the second conductor array 116, such that some of the strips of metal in the lead frame 112 extend continuously from the first end 208 to the second end 210. In an embodiment, the components of the lead frame 112 are formed in a single, common process, and the transition region 188 is integral to the ground conductors 110.

In an embodiment, the first and second holder members 146, 148 are formed via a molding process around the lead frame 112. For example, the first holder member 146 has an overmold body 212, and the second holder member 148 has an overmold body 214. The signal conductors 108 and the ground conductors 110 in the first conductor array 114 are at least partially embedded in the overmold body 212, which holds the signal and ground conductors 108, 110 in place. The signal and ground conductors 108, 110 in the second conductor array 116 are similarly at least partially embedded in the overmold body 214. The first and second overmold bodies 212, 214 may be formed by inserting the respective conductor arrays 114, 116 into molds and overmolding the conductor arrays 114, 116 with the heated overmold material that solidifies into the overmold bodies 212, 214 upon setting. The overmold body 212 is spaced apart from the overmold body 214 along the mating axis 191 in the pre-assembled state shown in FIG. 5. For example, the transition region 188 of the lead frame 112 is disposed between the overmold bodies 212, 214 and is not embedded in either of the overmold bodies 212, 214 (or any other overmold material).

In an embodiment, the overmold body 212 defines a pocket 200 that extends along the lateral axis 192 across at least some of the signal conductors 108 and ground conductors 110 in the first conductor array 114. The overmold body 214 also defines a pocket 202 that extends along the lateral axis 192 across at least some of the signal conductors 108 and ground conductors 110 in the second conductor array 116. The pockets 200, 202 are recessed from the respective outer sides 150, 154 of the holder members 146, 148. The pockets 200, 202 may be formed during the molding processes that form the overmold bodies 212, 214. As shown in FIG. 6, the pocket 200 is configured to receive the first ground bus plate 160 therein, and the pocket 202 is configured to receive the second ground bus plate 166 therein. The pockets 200, 202 are sized to hold and retain the first and second ground bus plates 160, 166 on the contact assembly 132.

The pockets 200, 202 further define slots 220 therein that align with the ground conductors 110. For example, the slots 220 extend along the mating axis 191 and are recessed beyond a floor 222 of the respective pockets 200, 202. As shown in FIG. 5, the ground conductors 110 in the first conductor array 114 are exposed in the pocket 200 via the slots 220. Although not shown, the ground conductors 110 in the second conductor array 116 are exposed in the pocket 202 via the corresponding slots 220. The signal conductors 108 are disposed between the slots 220. The portions of the signal conductors 108 that align with the pockets 200, 202 are encased in the respective overmold bodies 212, 214, so the portions of the signal conductors 108 within the pockets 200, 202 are covered and not exposed.

The contact assembly 132 is configured to be assembled by folding the first and second holder members 146, 148 relative to each other about the transition region 188. For example, the second holder member 148 may be pivoted relative to the first holder member 146 in a pivot direction 218 and/or the first holder member 146 may be pivoted relative to the second holder member 148 in a reverse direction. The transition region 188 functions as a hinge. The inner side 152 of the first holder member 146 directly or indirectly engages the inner side 156 of the second holder member 148 after folding the holder members 146, 148. Optionally, pins, latches, other fasteners, and/or an adhesive may be used to retain the first holder member 146 and the second holder member 148 in the resulting stacked orientation.

FIG. 6 is a cross-sectional view of the pluggable connector 100 taken along the line 6-6 shown in FIG. 3. The cross-section extends through a ground conductor 110A in the first conductor array 114 and a ground conductor 110B in the second conductor array 116. The ground conductor 110A shown in FIG. 6 may be representative or exemplary of all or at least some of the ground conductors 110 (shown in FIG. 5) in the first conductor array 114, such that the description of the ground conductor 110A may apply to all or at least some of the ground conductors 110 in the first conductor array 114. Similarly, the ground conductor 110B may be representative or exemplary of all or at least some of the ground conductors 110 in the second conductor array 116, such that the description of the ground conductor 110B may apply to all or at least some of the ground conductors 110 in the second conductor array 116.

The mating segment 184 of the ground conductor 110A extends along a first plane 196 on the outer side 150 of the first holder member 146. The mating segment 184 of the ground conductor 110B extends along a different, second plane 198 on the outer side 154 of the second holder member 148. The transition region 188 of the lead frame 112 interconnects the mating segment 184 of the ground conductor 110A with the mating segment 184 of the ground conductor 110B. The distal tip 195 of the ground conductor 110A extends out of the first plane 196 towards the seam 158. For example, the distal tip 195 in the illustrated embodiment is curved gradually vertically downwards towards the seam 158 and/or the second holder member 148. The distal tip 195 of the ground conductor 110B, on the other hand, extends out of the second plane 198 towards the seam 158, and the distal tip 195 is shown as being curved gradually vertically upwards towards the seam 158 and/or the first holder member 146. The transition region 188 of the lead frame 112 therefore electrically commons the ground conductors 110 in the first conductor array 114 with the ground conductors 110 in the second conductor array 116 at the mating end 104 of the pluggable connector 100. Thus, the transition region 188 is located at or proximate to a mating interface defined between the pluggable connector 100 and the mating receptacle connector. The transition region 188 may improve signal integrity of the mated pluggable connector 100 and receptacle connector by shortening the effective ground path length between grounding locations.

In an embodiment, the ground conductors 110A, 110B each define jogged segments 224 that are offset relative to the respective mating segments 184. For example, the jogged segment 224 of the ground conductor 110A is recessed relative to the outer side 150, and the jogged segment 224 of the ground conductor 110B is recessed relative to the outer side 154. The jogged segments 224 of the ground conductors 110A, 110B are disposed one above the other and are disposed between the mating segments 184 and the terminating ends 130 of the conductors 110A, 110B. The jogged segments 224 align with the respective pockets 200, 202 of the first and second holder members 146, 148. The jogged segments 224 of the ground conductors 110A, 110B are embedded in the respective first and second holder members 146, 148 along the pockets 200, 202, such that contact surfaces 226 of the ground conductors 110A, 110B are exposed (for example, not covered) for engaging and electrically connecting to the respective grounding beams 162, 167 of the first and second ground bus plates 160, 166.

The first ground bus plate 160 is disposed in the pocket 200, and the second ground bus plate 166 is disposed in the pocket 202. The grounding beam 162 of the first ground bus plate 160 engages the contact surface 226 of the jogged segment 224 of the ground conductor 110A. Similarly, the grounding beam 167 of the second ground bus plate 166 engages the contact surface 226 of the jogged segment 224 of the ground conductor 110B. For example, the valleys 206 of the grounding beams 162, 167 extend vertically inward towards the seam 158 to engage the contact surfaces 226 of the respective ground conductors 110A, 110B. The upper interior wall 172 (or a protrusion extending therefrom) of the housing 124 engages one or both peaks 204 of the grounding beam 162 to press the valleys 206 of the grounding beams 162 into engagement with the ground conductor 110A. Similarly, the lower interior wall 174 (or a protrusion extending therefrom) engages one or both peaks 204 of the grounding beams 167 to press the valleys 206 of the grounding beam 167 into engagement with the ground conductor 110B.

Figure 7:
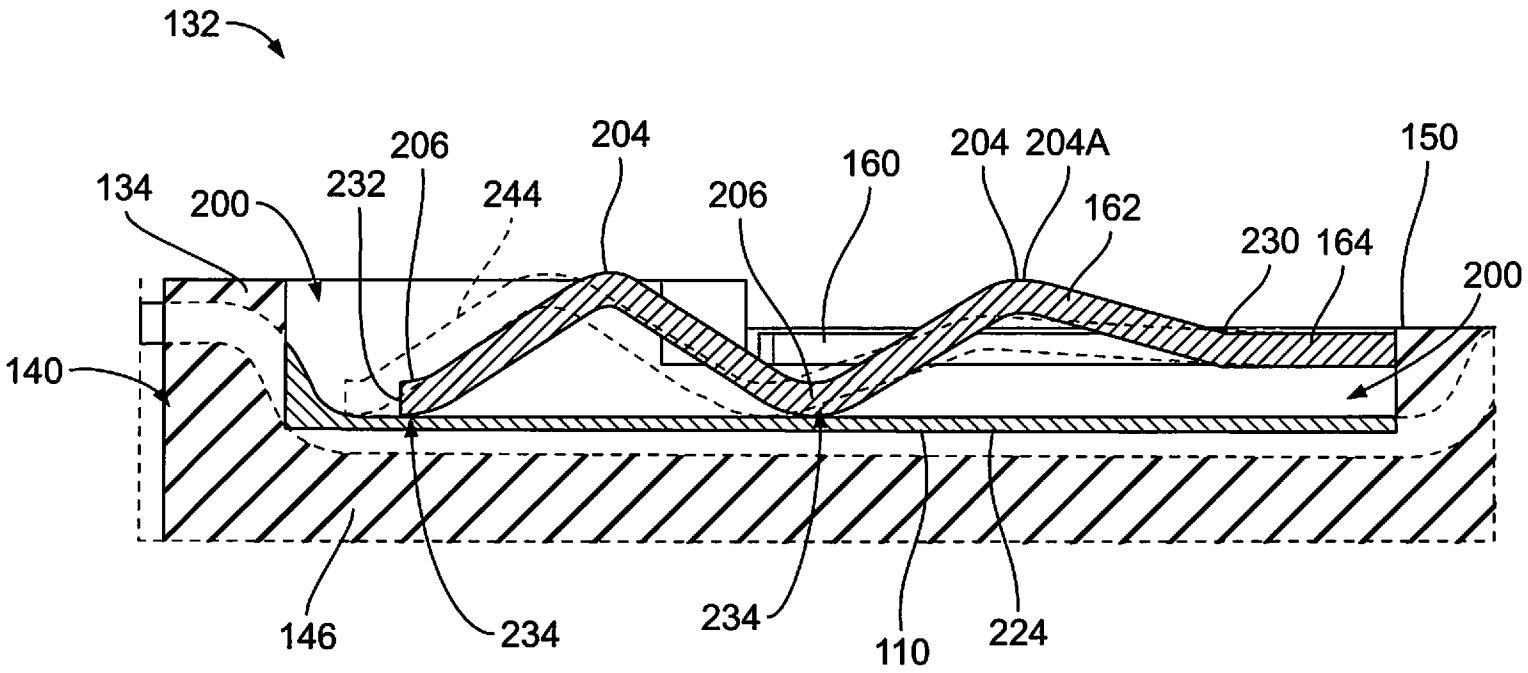
FIG. 7 is an enlarged cross-sectional view of a portion of the contact assembly showing a grounding beam of a first ground bus plate in a pocket of a first holder member.

FIG. 7 is an enlarged cross-sectional view of a portion of the contact assembly 132 showing a grounding beam 162 of the first ground bus plate 160 in the pocket 200 of the first holder member 146. In FIG. 7, the contact assembly 132 is not loaded in the housing 124 (shown in FIG. 6), so the grounding beam 162 is in a pre-loaded state and not engaged by the housing 124. The grounding beam 162 has an undulating contour, and may resemble a linear spring. The grounding beam 162 extends from a fixed end 230 that is connected to the base plate 164 to a distal, free end 232. At least one of the peaks 204 of the grounding beam 162 extends vertically above the outer side 150 of the first holder member 146. The valleys 206 extend vertically below the outer side 150 and vertically below the base plate 164 of the ground bus plate 160. In the pre-loaded state, the two valleys 206 of the grounding beam 162 engage the recessed or jogged segment 224 of the ground conductor 110 at two points of contact 234 that are spaced apart longitudinally.

When the contact assembly 132 is loaded in the housing 124 (shown in FIG. 6), one of the ribs 240 (FIG. 3) extending from the upper interior wall 172 (FIG. 3) is configured to engage at least one of the peaks 204 of the grounding beam 162 to at least partially deflect the grounding beam 162 towards the ground conductor 110 to ensure and retain the mechanical engagement between the grounding beam 162 and the ground conductor 110. For example, the rib 240 may engage and press a first peak 204A of the two peaks 204, which elongates or lengthens the grounding beam 162, moving the free end 232 closer towards the rear end 140 of the holder 134. A phantom outline 244 of the grounding beam 162 in the loaded state, meaning when the contact assembly 132 is loaded in the housing 124, is shown in FIG. 7. The phantom outline 244 shows that the two points of contact 234 of the pre-loaded state have shifted in the direction towards the rear end 140.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A pluggable connector comprising:

a lead frame defining a first conductor array of ground conductors and signal conductors interspersed along a first row, a second conductor array of ground conductors and signal conductors interspersed along a second row, and a transition region that interconnects the first and second conductor arrays, the transition region including a ground tie bar and distal tips of the ground conductors in the first and second conductor arrays that extend from the ground tie bar; and a holder that holds the lead frame, the holder extending between a front end and a rear end, the holder being defined by first and second holder members each having a respective outer side and an inner side, the inner sides of the first and second holder members facing one another and defining a seam therebetween, the first holder member holding the first conductor array of the lead frame at least partially along the outer side thereof, the second holder member holding the second conductor array of the lead frame at least partially along the outer side thereof;

wherein the transition region of the lead frame extends across the seam at the front end of the holder.

2. The pluggable connector of claim 1, wherein the front end of the holder includes a front wall that extends between the outer side of the first holder member and the outer side of the second holder member, the ground tie bar being disposed along the front wall and aligning with the seam between the first and second holder members.

3. The pluggable connector of claim 1, wherein the inner side of the first holder member abuts the inner side of the second holder member at the seam.

4. The pluggable connector of claim 1, wherein the signal conductors and the ground conductors of the lead frame have mating segments proximate to the front end of the holder, the mating segments in the first conductor array extending along a first plane on the outer side of the first holder member, the mating segments in the second conductor array extending along a different, second plane on the outer side of the second holder member, the transition region of the lead frame interconnecting the mating segments of the ground conductors in the first conductor array with the mating segments of the ground conductors in the second conductor array.

5. The pluggable connector of claim 4, wherein the distal tips of the ground conductors in the first conductor array are curved out of the first plane towards the seam, and the distal tips of the ground conductors in the second conductor array are curved out of the second plane towards the seam.

6. The pluggable connector of claim 1, wherein the first and second holder members each have an overmold body, the ground conductors and the signal conductors in the first conductor array being at least partially embedded in the overmold body of the first holder member to hold the ground conductors and the signal conductors in place, the ground conductors and the signal conductors in the second conductor array being at least partially embedded in the overmold body of the second holder member to hold the ground conductors and the signal conductors in place, wherein the transition region of the lead frame is not embedded in either of the respective overmold bodies of the first and second holder members.

7. The pluggable connector of claim 6, wherein the overmold bodies of the first and second holder members each define a pocket along the respective outer side thereof, the ground conductors being exposed in the respective pockets, the pluggable connector further comprising a first ground bus plate received in the pocket of the first holder member and a second ground bus plate received in the pocket of the second holder member, the first and second ground bus plates extending across at least some of the ground conductors in the respective first and second conductor arrays, the first and second ground bus plates including grounding beams that each align with and engage a corresponding ground conductor at multiple points of contact.

8. The pluggable connector of claim 1, wherein the ground conductors and the signal conductors of the lead frame extend parallel to a mating axis, the ground tie bar extending transverse to the mating axis.

9. A pluggable connector comprising:

a lead frame defining a first conductor array of ground conductors and signal conductors interspersed along a first row, a second conductor array of ground conductors and signal conductors interspersed along a second row, and a transition region that interconnects the first and second conductor arrays, the transition region including a ground tie bar and distal tips of the ground conductors in the first and second conductor arrays that extend from the ground tie bar;

a holder extending between a front end and a rear end, the holder being defined by first and second holder members each having a respective outer side and an inner side, the inner sides of the first and second holder members facing one another and defining a seam therebetween, the first holder member holding the first conductor array of the lead frame, the second holder member holding the second conductor array of the lead frame, the transition region of the lead frame extending across the seam at the front end of the holder, the first holder member defining a pocket along the outer side thereof, the pocket extending across at least some of the ground conductors and the signal conductors in the first conductor array, the ground conductors in the pocket being exposed, the signal conductors in the pocket being covered; and a first ground bus plate received in the pocket of the first holder member, the first ground bus plate including grounding beams extending therefrom that each align with and engage a corresponding ground conductor in the pocket.

10. The pluggable connector of claim 9, wherein the ground conductors and the signal conductors in the first conductor array define mating segments and jogged segments that are offset relative to one another, the mating segments being disposed along the outer side of the first holder member proximate to the front end of the holder, the jogged segments being recessed relative to the outer side and disposed between the mating segments and the rear end of the holder, the pocket aligning with the jogged segments of the ground conductors and the signal conductors.

11. The pluggable connector of claim 10, wherein the first holder member includes an overmold body, the mating segments and the jogged segments of the ground conductors and the mating segments of the signal conductors being embedded in the overmold body, the jogged segments of the signal conductors being encased in the overmold body.

12. The pluggable connector of claim 9, wherein the ground tie bar is integral to the distal tips of the ground conductors in the first and second conductor arrays such that the ground conductors extend from the ground tie bar.

13. The pluggable connector of claim 9, wherein at least some of the grounding beams of the first ground bus plate each have an undulating contour including peaks that extend vertically above the outer side of the first holder member and valleys that extend vertically below the outer side of the first holder member to engage a recessed portion of a corresponding ground conductor at multiple points of contact.

14. The pluggable connector of claim 13, further comprising a housing extending between a front end and a rear end and having interior walls that define a slot extending between the front and rear ends, the holder with the lead frame and the first ground bus plate held thereon extending through the slot of the housing such that the front end of the holder protrudes from the front end of the housing, one of the interior walls of the housing engaging the peaks of the grounding beams of the first ground bus plate to press the valleys of the grounding beams into engagement with the corresponding ground conductors in the first conductor array.

15. The pluggable connector of claim 9, wherein the second holder member defines a pocket along the outer side thereof, the pocket extending across at least some of the ground conductors and the signal conductors in the second conductor array, the ground conductors in the pocket being exposed, the signal conductors in the pocket being covered; and wherein the pluggable connector further comprises a second ground bus plate received in the pocket of the second holder member, the second ground bus plate including grounding beams extending therefrom that each align with and engage a corresponding ground conductor in the pocket at multiple points of contact.

16. A pluggable connector comprising:

a holder extending between a front end and a rear end, the holder having a top side and a bottom side, the holder defining a first pocket along the top side and a second pocket along the bottom side;

ground conductors and signal conductors arranged in a first conductor array along the top side and in a second conductor array along the bottom side, at least some of the ground conductors spanning from the top side to the bottom side, at least some of the ground conductors and the signal conductors defining a mating segment proximate to the front end of the holder and a jogged segment that is offset relative to the mating segment and located between the mating segment and the rear end, the jogged segments of the ground conductors and the signal conductors in the first and second conductor arrays extending through the first and second pockets of the holder, respectively, the ground conductors being exposed in the respective first and second pockets; and first and second ground bus plates received in the first and second pockets, respectively, of the holder, the first and second ground bus plates each including grounding beams extending therefrom, the grounding beams of the first ground bus plate aligning with and engaging corresponding ground conductors in the first pocket at multiple points of contact, the grounding beams of the second ground bus plate aligning with and engaging corresponding ground conductors in the second pocket at multiple points of contact.

17. The pluggable connector of claim 16, wherein the ground conductors in the first conductor array are interconnected to the ground conductors in the second conductor array via a ground tie bar that extends along the front end of the holder.

18. The pluggable connector of claim 17, wherein the mating segments of the ground conductors and the signal conductors in the first conductor array extend along a first plane on the top side of the holder, the mating segments of the ground conductors and the signal conductors in the second conductor array extending along a different, second plane on the bottom side of the holder, the ground tie bar being disposed between the first and second planes, the ground conductors in the first conductor array having distal tips that extend out of the first plane to the ground tie bar, the ground conductors in the second conductor array having distal tips that extend out of the second plane to the ground tie bar.

19. The pluggable connector of claim 16, wherein the grounding beams of the first and second ground bus plates have undulating contours including peaks and valleys, the peaks of the grounding beams of the first ground bus plate extending vertically outward beyond the top side of the holder and the peaks of the grounding beams of the second ground bus plate extending vertically outward beyond the bottom side of the holder, the valleys of the grounding beams of the first and second ground bus plates extending vertically inward and engaging the jogged segments of the ground conductors in the respective first and second conductor arrays.

20. The pluggable connector of claim 16, further comprising a housing extending between a front end and a rear end and having upper and lower interior walls that at least partially define a slot extending between the front and rear ends, the holder with the ground and signal conductors and the first and second ground bus plates held thereon extending through the slot of the housing such that the front end of the holder protrudes from the front end of the housing, the upper interior wall of the housing engaging the grounding beams of the first ground bus plate to press the grounding beams into engagement with the corresponding ground conductors in the first conductor array, the lower interior wall of the housing engaging the grounding beams of the second ground bus plate to press the grounding beams into engagement with the corresponding ground conductors in the second conductor array.

* * * * *